US006446393B1

(12) United States Patent
Marston, Sr. et al.

(10) Patent No.: US 6,446,393 B1
(45) **Date of Patent: *Sep. 10, 2002**

(54) WATERTIGHT DOOR APPARATUS

(75) Inventors: Matthew Jay Marston, Sr., Boothbay; John Alford Miller, Bath; Conrad Stone Brooks, Rockport; Pantelis Zolas; Stephen James Nicholson, both of Brunswick, all of ME (US)

(73) Assignee: Bath Iron Works Corporation, Bath, ME (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/570,420

(22) Filed: May 12, 2000

(51) Int. Cl.[7] ..... E05C 9/00
(52) U.S. Cl. ..... 49/395; 292/48; 292/196
(58) Field of Search ..... 49/394, 395; 292/196, 292/48

(56) References Cited

U.S. PATENT DOCUMENTS

| | | | | | |
|---|---|---|---|---|---|
| 37,849 | A | * | 3/1863 | Becker | 49/395 |
| 633,552 | A | | 9/1899 | Kenny | |
| 678,407 | A | | 7/1901 | Lee | |
| 1,935,882 | A | | 11/1933 | Le Beau | 189/46 |
| 2,146,700 | A | | 2/1939 | Peterson | 292/48 |
| 2,271,952 | A | | 2/1942 | Raus | 114/117 |
| 2,295,324 | A | | 9/1942 | Arthur | 292/48 |
| 2,315,239 | A | | 3/1943 | Young | |
| 2,440,764 | A | | 5/1948 | Wilson | 189/46 |
| 2,460,961 | A | | 2/1949 | Wilson | 292/48 |
| 2,468,251 | A | | 4/1949 | Wiederman | 114/117 |
| 2,493,882 | A | | 1/1950 | Lambert | 292/12 |
| 2,511,267 | A | | 6/1950 | Jacob | 114/117 |
| 2,511,268 | A | | 6/1950 | Schiff | 114/117 |
| 2,844,118 | A | | 7/1958 | Kummerman | 114/202 |
| 2,863,688 | A | | 12/1958 | Endter | 292/221 |
| 2,941,831 | A | | 6/1960 | Borsani | 292/79 |
| 3,302,331 | A | | 2/1967 | Sturm et al. | 49/248 |
| 3,988,859 | A | | 11/1976 | Peterson | 49/394 |
| 4,114,424 | A | | 9/1978 | Johnson | 73/40 |
| 5,031,863 | A | | 7/1991 | Noble | 244/129.5 |
| 5,086,587 | A | | 2/1992 | Andrews | 49/395 |
| 5,120,087 | A | | 6/1992 | Pastva | 292/22 |
| 5,199,369 | A | | 4/1993 | Meyer et al. | 114/117 |
| 5,216,840 | A | | 6/1993 | Andrews | 49/483.1 |
| 5,305,969 | A | | 4/1994 | Odell et al. | 244/129.5 |
| 5,333,920 | A | * | 8/1994 | de Rover | 292/48 |
| 5,392,900 | A | | 2/1995 | Sandwall | 198/860.4 |
| 5,542,213 | A | | 8/1996 | Freeman | 49/221 |
| 5,600,921 | A | | 2/1997 | Vardaro | 49/380 |
| 5,848,575 | A | | 12/1998 | Freeman et al. | 114/117 |
| 6,101,764 | A | * | 8/2000 | Guy-Paul | 49/367 X |
| 6,123,370 | A | * | 9/2000 | Rozema et al. | 292/47 |

FOREIGN PATENT DOCUMENTS

| | | | | |
|---|---|---|---|---|
| CH | 431007 | * | 4/1967 | 49/395 |
| EP | 512588 A1 | | 11/1992 | |
| EP | 518429 A1 | | 12/1992 | |
| EP | 551615 A1 | | 12/1992 | |
| EP | 876954 A2 | | 11/1998 | |
| JP | 57114788 | | 7/1982 | |

* cited by examiner

*Primary Examiner*—Jerry Redman
(74) *Attorney, Agent, or Firm*—Jenner & Block, LLC

(57) ABSTRACT

A watertight door apparatus includes a door, a door frame, a number of dogging elements, and an actuator mechanism for toggling the dogging elements between a latched condition and an unlatched condition. The dogging elements include roller elements for reducing friction between mating parts. A detent mechanism is provided to prevent inadvertent operation of the actuator mechanism. The dogging elements can be configured to rotate into and out of the latched condition, or they can be configured to slide into and out of the latched condition.

21 Claims, 9 Drawing Sheets

WATERTIGHT DOOR APPARATUS

This invention was made with government support under contract number N0002497-C-2202 awarded by the Department of the Navy. The United States Government has certain rights in this invention.

BACKGROUND OF THE INVENTION

1. The Technical Field

The present invention relates generally to watertight and airtight doors. More particularly, the present invention relates to dogging mechanisms for such doors.

2. The Prior Art

Watertight doors are well known in the art. Such doors commonly are used to prevent water infiltration from one compartment of a ship to another or from one area of a building to another. Such doors also can be used to prevent infiltration of air or other gas or vapor from one volume to another. A watertight door assembly typically comprises a door; a door frame; a hinge mechanism for pivoting the door about the door frame; a resilient, compressible seal for effecting a watertight seal between the door and the door frame; and a dogging mechanism for securing, or dogging, the door in the closed position against the door frame.

A dogging mechanism generally includes a number of dogs for pinning the closed door tightly against the compressible seal and the door frame via an actuator and linkage for engaging and disengaging the dogs. The dogging mechanism typically is attached either to the door or to the door frame. In applications where the dogging mechanism is attached to the door, manipulation of a door-mounted actuator and linkage causes dogs mounted on the door to engage with points about the perimeter of the door frame, thus pinning the door against the door frame. In applications where the dogging mechanism is attached to the door frame, manipulation of a frame-mounted actuator causes dogs mounted on the door frame to engage with points about the perimeter of the door, thus pinning the door against the door frame.

A dogging mechanism typically relies on friction in the mechanism and particularly between the dogs and the door/frame contact points to hold the dogs in the dogged position. Because the dogs rub against the door/frame contact points each time the dogging mechanism is actuated, the dogs and/or the engagement points on the door/frame wear over time. As the wear approaches a certain limit, the mechanism may lose its ability to hold the dogging mechanism in the dogged position by friction alone. Further, the mechanism eventually may cease to provide adequate compression of the resilient, compressible seal to afford watertightness. Consequently, conventional dogs and dogging mechanisms require regular, and in some cases frequent, maintenance to ensure proper functionality of the doors they are associated with.

Excessive force often is required to engage and disengage the dogs from the door/frame when securing and unsecuring the door, respectively. This force is transferred through the dog actuator mechanism to the operating handle. Gear reduction principles can be used to reduce the handle force required to operate the mechanism to a reasonable level. However, when gear reduction is used to decrease handle operating force, handle travel necessarily increases. Where allowable handle travel is a limiting factor, it might not be possible to reduce handle operating force to a reasonable level using gear reduction alone.

It therefore is an object of the invention to provide a novel watertight door assembly having a dogging mechanism which has the attributes of high reliability, low maintenance, reasonable operating force, and acceptable handle travel.

SUMMARY OF THE INVENTION

A watertight door according to a preferred embodiment of the invention includes a door, a door frame, a hinge or binges connecting the door to the door frame, a resilient compressible seal, and a dogging mechanism for securing the door to the door frame when the door is in the closed position. The dogging mechanism includes a number of dogs and an actuator and linkage for operating the dogs between a dogged and an undogged position. The dogging mechanism can be mounted on the door frame or on the door itself. Preferably, the dogging mechanism includes eight dogs, but more or fewer dogs can be provided. Preferably, a dog is located at each comer of the door and one or more dogs are located along each doorjamb. A dog can be, but need not be, located along each of the door header and door sill, as well.

In a first preferred embodiment of the invention, each of the dogs is a bar attached at one end to a pivot point on the door frame in a manner that allows the dog to rotate about the pivot point and against a corresponding contact location on the door. The contact location preferably is shaped so that the dog imparts a force on the door which increases with the dog's rotational travel over the contact location This increasing force tends to compress the door against the door frame and the resilient, compressible seal therebetween.

Preferably, the rotating dogs of this embodiment are actuated using a chain-and-sprocket and bellcrank linkage mechanism, although other actuator mechanisms also can be used therewith. Each comer dog preferably is attached to a sprocket which can rotate in response to an appropriate force applied to the sprocket by a chain actuator. Each of the dogs located along the jambs, header, and/or sill preferably is attached to a bellcrank which causes the dog to rotate in response to an appropriate force applied to the bellcrank by a linkage mechanism.

In a second preferred embodiment of the invention, each of the dogs is a bar attached to the door frame in a manner that allows the dog to be actuated linearly in a direction which is substantially parallel to the plane of the door and substantially perpendicular to the edge of the door and door frame at the point of engagement. In this embodiment, each of the dogs is actuated so that the dog makes contact with and slides against a corresponding contact location on the door. The contact location preferably is shaped so the dog imparts a force on the door which increases with the dog's linear travel over the contact location. As in the first preferred embodiment, this increasing force tends to compress the door against the door frame and the resilient, compressible seal therebetween.

Preferably, the linear dogs of this embodiment are actuated using a rack-and-pinion actuator mechanism, although other actuator mechanisms can be used therewith. Each linear dog preferably includes a toothed portion resembling a gear rack which engages with a corresponding pinion gear. Rotation of the pinion gear imparts linear motion to the linear dog, causing the linear dog to extend from the door frame towards the door or to retract from the door towards the door frame. Rotation is imparted to the pinion gear by the linear motion of a corresponding actuator gear rack. Preferably, the rack-and-pinion actuator mechanism forms a closed loop wherein all of the moving parts of the rack-and-pinion mechanism are interconnected.

In either of the foregoing embodiments, each dog preferably includes a roller element which rolls over the corresponding contact location on the door. The roller element reduces friction between the dog and the contact location and therefore reduces the force required to operate the dog actuator. The reduced friction forces between the dog and contact location reduce the tendency for friction alone to maintain the dog in the dogged position. To mitigate this effect, each contact location preferably is specially shaped to include a detent which cradles the roller element when the roller element is in the fully dogged position and therefore inhibits undesired undogging.

BRIEF DESCRIPTION OF THE DRAWINGS

FIG. 3A is a detailed side elevation view of a portion of a chain and sprocket actuator mechanism according to a first preferred embodiment of the present invention;

DETAILED DESCRIPTION OF THE DRAWINGS

Figure 1:
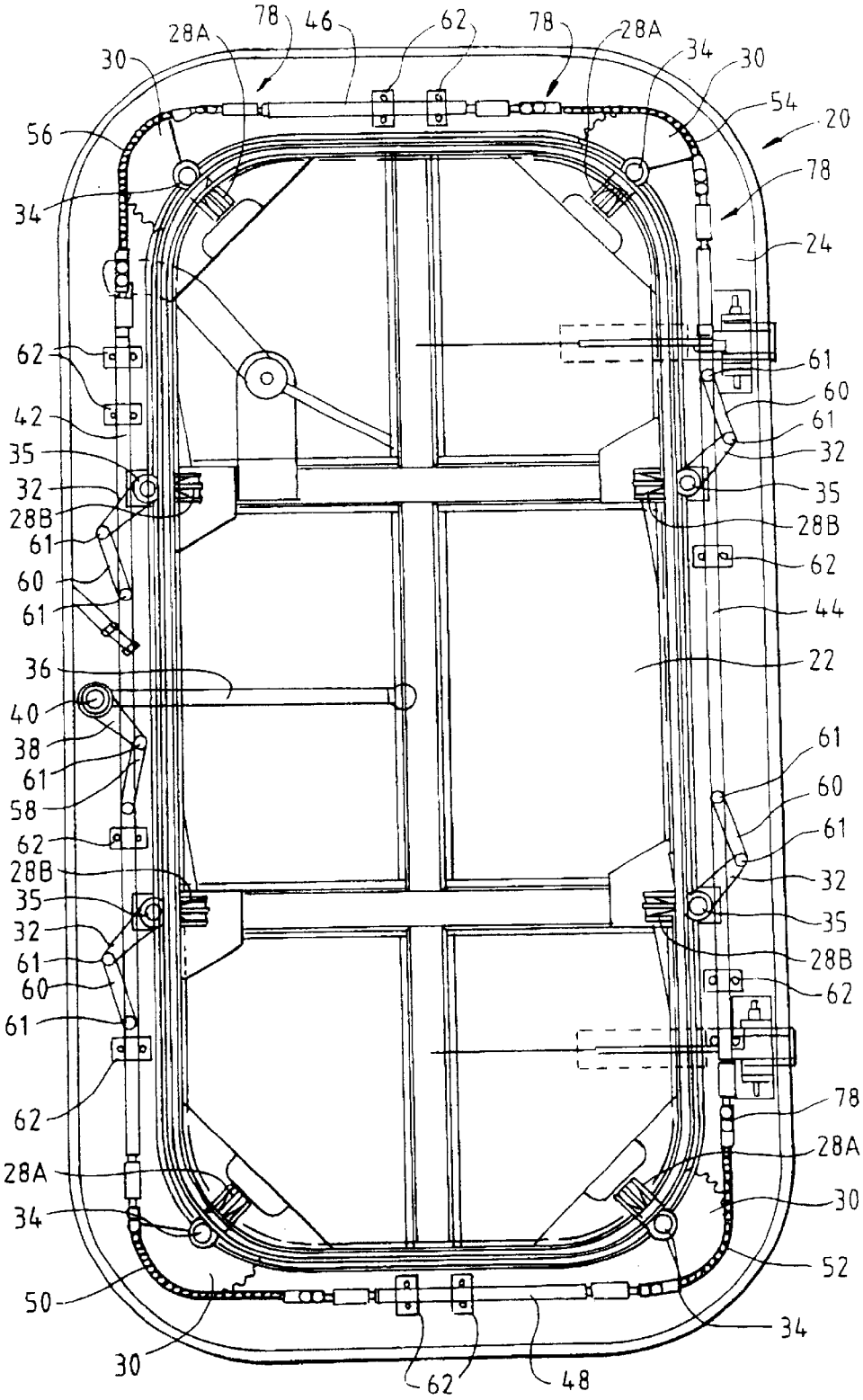
FIG. 1 is a front elevation view of a door closure mechanism in the dogged position according to a first preferred embodiment of the present invention.
Figure 2:
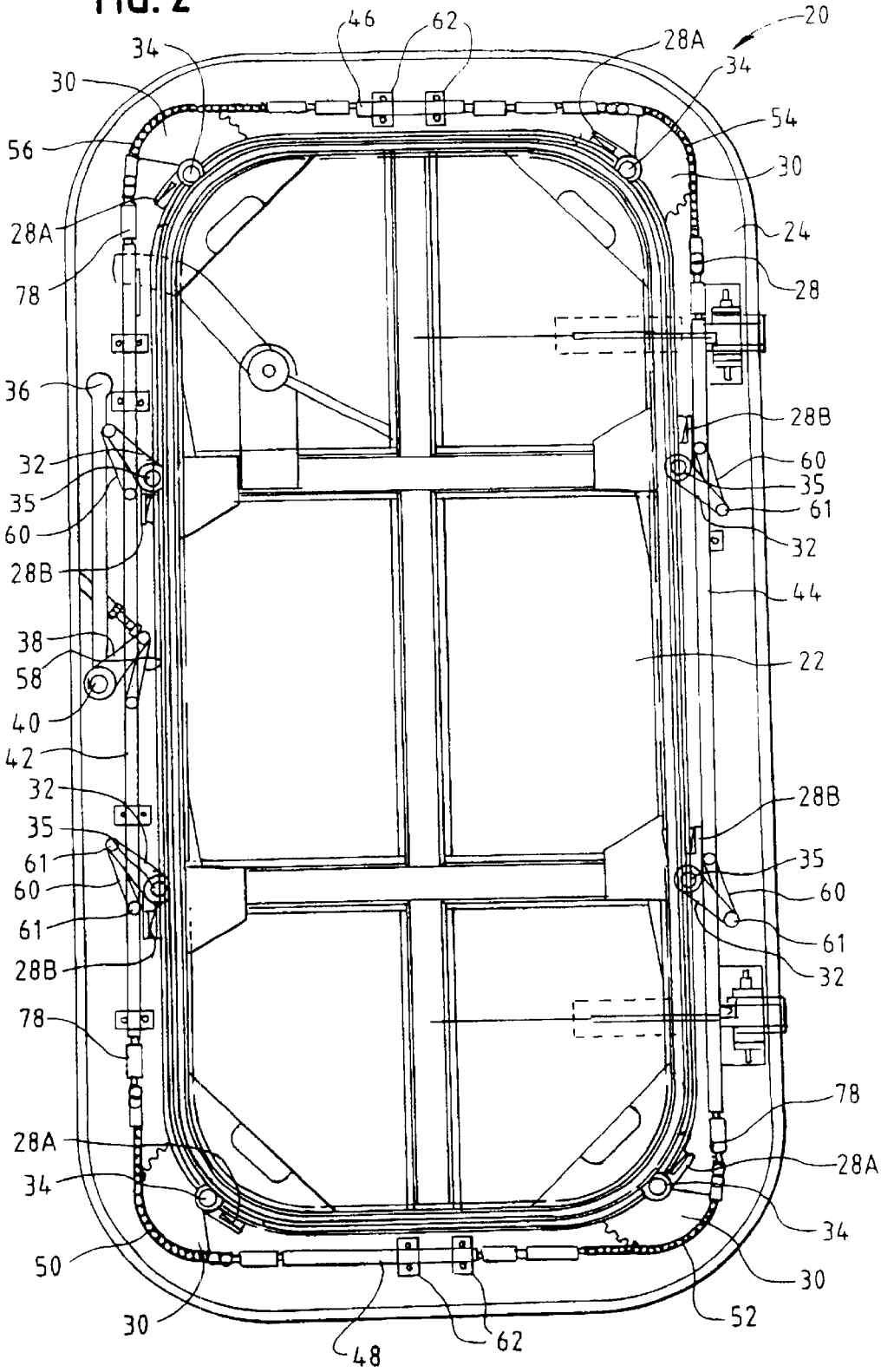
FIG. 2 is a front elevation view of a door closure mechanism in the undogged position according to a first preferred embodiment of the present invention.

FIGS. 1 and 2 illustrate a preferred embodiment of a watertight door assembly 20 according to the present invention. Assembly 20 includes a door 22, a door frame 24, a door seal (not shown), and a dogging mechanism for securing the door in the closed position.

A preferred dogging mechanism includes eight rotating dogs 28A and 28B mounted on axles 34 which in turn are attached to door frame 24. Rotating dogs 28A, 28B can be rotated about axles 34 into and out of contact with contact locations on door 22 to secure door 22 to door frame 24. Four rotating dogs 28A are located about the comer areas of door frame 24. The other four rotating dogs 28B are located about door frame 24 at points between the comer areas of door frame 24.

Figure 3A:
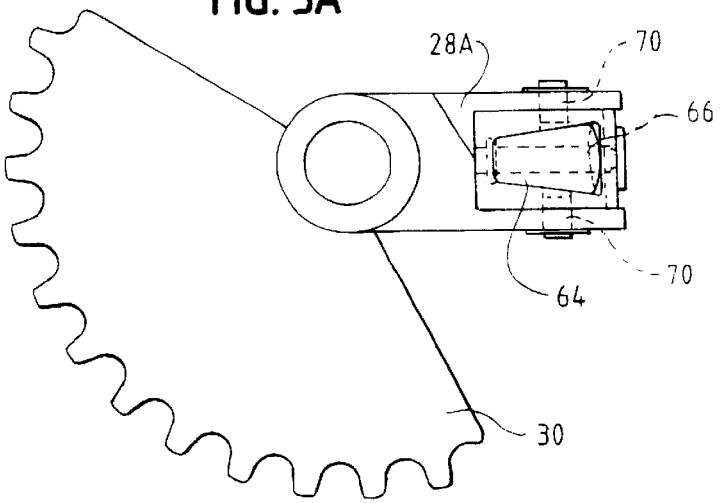
FIG. 3A is a detailed plan view of a portion of a chain and sprocket actuator mechanism according to a first preferred embodiment of the present invention.
Figure 3B:
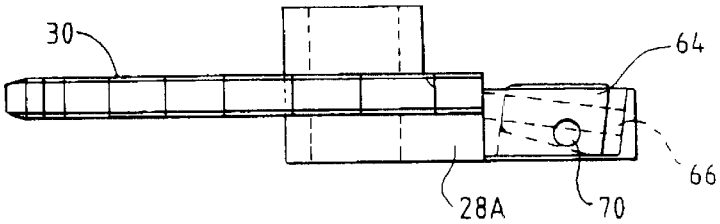

As further illustrated in FIGS. 3A and 3B, a sprocket 30 is attached to each rotating dog 28A so that rotating dog 28A can rotate about axle 34 in response to an appropriate force imparted to sprocket 30, as would be known to one skilled in the art. Preferably, sprocket 30 is integrally attached to rotating dog 28A, although sprocket 30 can be attached to rotating dog 28A in other ways, as well.

Figure 4:
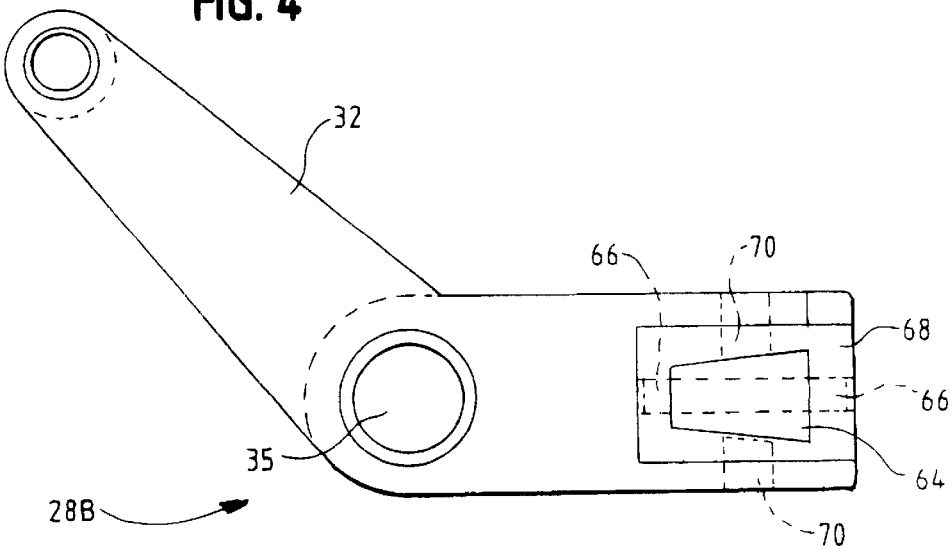
FIG. 4 is a detailed view of another portion of a rotating dog assembly according to a first preferred embodiment of the present invention.

As further illustrated in FIG. 4, a dog bellcrank 32 is attached to each rotating dog 28B. Rotating dog 28B can rotate about axle 35 in response to an appropriate force imparted to dog bellcrank 32. Preferably, rotating dog 28A and dog bellcrank 32 are integrally attached, although rotating dog 28A can be attached to dog bellcrank 32 in other ways, as well.

The dogging mechanism also includes a handle 36 and a handle bellcrank 38 which is attached to handle 36. Handle 36 and handle bellcrank 38 attached thereto are mounted on a handle axle 40, which in turn is mounted on door frame 24, in a manner that allows handle 36 and handle bellcrank 38 to pivot about handle axle 40 in response to an appropriate force imparted to handle 36.

The dogging mechanism further includes a dogging linkage, which connects handle 36 to each of sprockets 30 and dog bellcranks 32 in a manner that causes sprockets 30 and dog bellcranks 32 to react to motion imparted to handle 36. The dogging linkage includes left side jamb linkage rod 42, right side jamb linkage rod 44, header linkage rod 46, and sill linkage rod 48; lower left comer chain 50, lower right corner chain 52, upper right comer chain 54, and upper left comer chain 56; handle bellcrank tie rod 58; and dog bellcrank tie rods 60. Handle bellcrank tie rod 58 is connected to handle bellcrank 38 using a hinge pin 61 so that handle bellcrank tie rod 58 and handle bellcrank 38 can pivot about the hinge pin 61. Each dog bellcrank tie rod 60 is connected to the corresponding dog bellcrank 32 in a similar manner. Further, handle bellcrank tie rod 58 and each of dog bellcrank tie rods 60 is connected to the corresponding jamb linkage rod 42, 44 in a similar manner. The foregoing linkage rods 42, 44, 46, 48 and comer chains 50, 52, 54, 56 are connected together as illustrated in FIGS. 1 and 2, preferably using clevis-type connections 78, as would be known to one skilled in the art.

Figure 10:
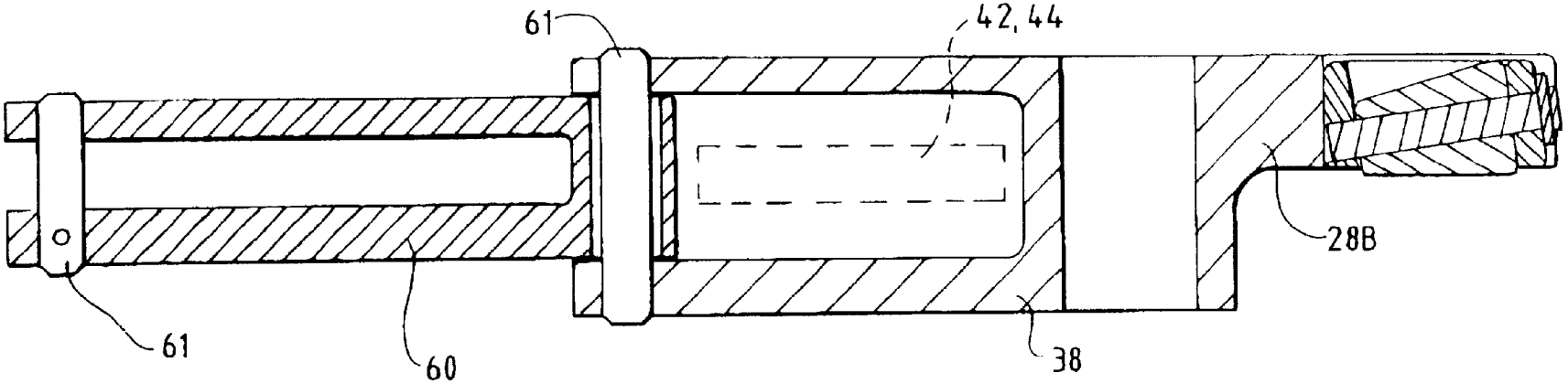
FIG. 10 is a side elevation view of a rotating dog, dog bellcrank, and tie rod assembly according to a first preferred embodiment of the present invention.

Referring to FIGS. 1, 2, and 10, each dog bellcrank 32 and dog bellcrank tie rod preferably is constructed so that the corresponding jamb linkage rod 42, 44 can slide through voids therein. Handle bellcrank 38 and handle bellcrank tie rod 58 preferably are constructed in a similar manner.

Each of comer chains 50, 52, 54, 56 engages with the teeth of corresponding sprocket 30. Each of linkage rods 42, 44, 46, 48 is supported on door frame 24 using linkage rod supports 62 in a manner that permits linkage rods 42, 44, 46, 48 to slide freely therethrough in response to an appropriate force imparted to any of linkage rods 42, 44, 46, 48. Linkage rods 42, 44, 46, 48 and linkage rod supports 62 preferably are oriented on door frame 24 so that each of linkage rods 42, 44, 46, 48 is substantially tangential to the perimeter of the sprockets 30 adjacent the ends of each such linkage rod, so that substantially no angle is formed between the any of said linkage rods and the ends of corner chains 50, 52, 54, 56 connected thereto, as illustrated in FIGS. 1 and 2.

In operation, as handle 36 is moved from its dogged position (see FIG. 1) to its undogged position (see FIG. 2) handle bellcrank 38 attached to handle 36 causes handle bellcrank tie rod 58 to move in a manner that causes left side jamb linkage rod 42 to move in an upwardly vertical direction. As can be seen from inspection of FIGS. 1 and 2, this upwardly vertical motion of left side jamb linkage rod 42 causes each of corner chains 50, 52, 54, 56 to be tensioned in a manner that causes each of sprockets 30 and rotating dogs 28A attached thereto to rotate about corresponding axle 34 in a clockwise direction, thus disengaging rotating dogs 28A from door 22.

The upwardly vertical motion of left side jamb linkage rod 42 indirectly causes downwardly vertical motion of right sidejamb linkage rod 44. The upwardly vertical motion of left side jamb linkage rod 42 and the corresponding downwardly vertical motion of right side jamb linkage rod 44 impart motion to each of dog bellcrank tie rods 60 such that each dog bellcrank 32 and the attached rotating dog 28B rotate about corresponding axle 35 in a clockwise direction, thus causing rotating dog 28B to disengage from door 22.

When handle 36 is manipulated from the undogged position shown in FIG. 2 to the dogged position shown in FIG. 1, handle bellcrank 38 causes handle tie rod 58 to move in a manner that causes left side jamb linkage rod 42 to move in a downwardly vertical direction. As can be seen from inspection of FIGS. 1 and 2, this downwardly vertical motion of left side jamb linkage rod 42 directly or indirectly tensions each of corner chains 50, 52, 54, 56 causing each of sprockets 30 and rotating dogs 28A attached thereto to rotate about corresponding axle 34 in a counterclockwise direction, thus engaging rotating dogs 28A with door 22.

The downwardly vertical motion of left side jamb linkage rod 42 indirectly causes upwardly vertical motion of right side jamb linkage rod 44. The downwardly vertical motion of left side jamb linkage rod 42 and the corresponding upwardly vertical motion of right side jamb linkage rod 44 impart motion to each of dog bellcrank link rods 60 such that each dog bellcrank 32 and the attached rotating dog 28B rotate about corresponding axle 35 in a counterclockwise direction, thus causing rotating dog 28B to disengage from door 22.

FIGS. 3A, 3B, and 4 illustrates a preferred embodiment of a rotating dog 28A, 28B in greater detail. A rotating dog 28A, 28B preferably includes a roller assembly comprising a roller element 64 which is free to rotate about a roller axle 66 that is secured within a roller cradle 68. Preferably, roller axle 66 is a single element which penetrates the entire length of roller element 64 through a bore 65 in roller element 64, as illustrated in FIG. 3. Alternatively, roller axle 66 can take the form of a pair of half axles (not shown), each of which penetrates a counterbore (not shown) formed into each end of roller element 64. Roller cradle 68 is free to pivot about a cradle axle 70 which, in turn, is attached to rotating dog 28. In operation, as roller element 64 rolls across a corresponding contact location on door 22, roller cradle 68 freely pivots to maintain even contact and alignment between roller element 64 and the contact location on door 22.

As each rotating dog 28A, 28B rotates about its corresponding axle 34, 35, each roller element 64 makes contact with and rolls across the corresponding contact location on door 22 in an arc defined by the rotation of rotating dog 28A, 28B. As is known to those skilled in the art, the end of roller element 64 which is farther from axle 34, 35 travels farther through such arc than does the end of roller element 64 which is nearer to axle 34, 35. Therefore, if roller element 64 were of constant diameter throughout its length, there would be a tendency for portions of roller element 64 to skid across the surface of door 22 at the corresponding contact location during the rotation of rotating dog 28A, 28B. To reduce the tendency for such skidding, roller element 64 preferably is tapered in the form of a truncated cone, such that the end of roller element 66 farther from rotating dog axle 35 is of greater diameter than the end of roller element 64 nearer to axle 34. By selecting the appropriate taper, which is a function of the arc radius through which rotating dog 28A, 28B travels, skidding can be virtually eliminated.

Figure 5A:
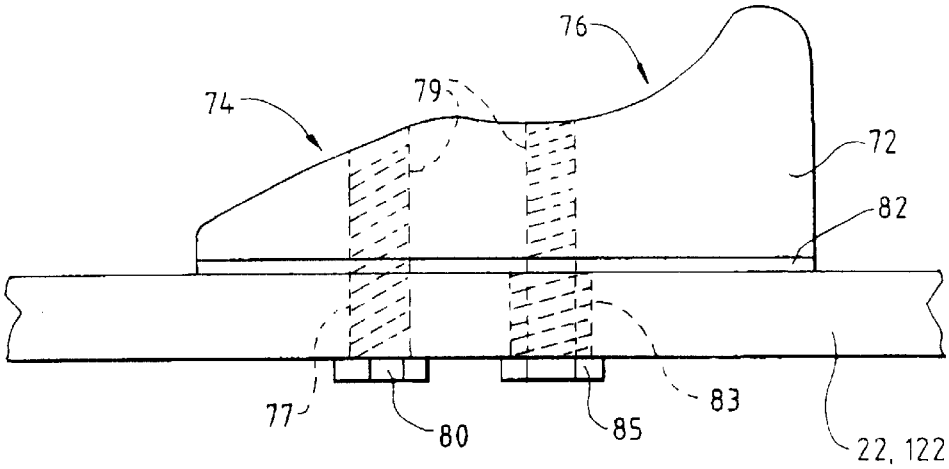
FIG. 5A is a side elevation view of a dogging wedge according to a preferred embodiment of the present invention.
Figure 5B:
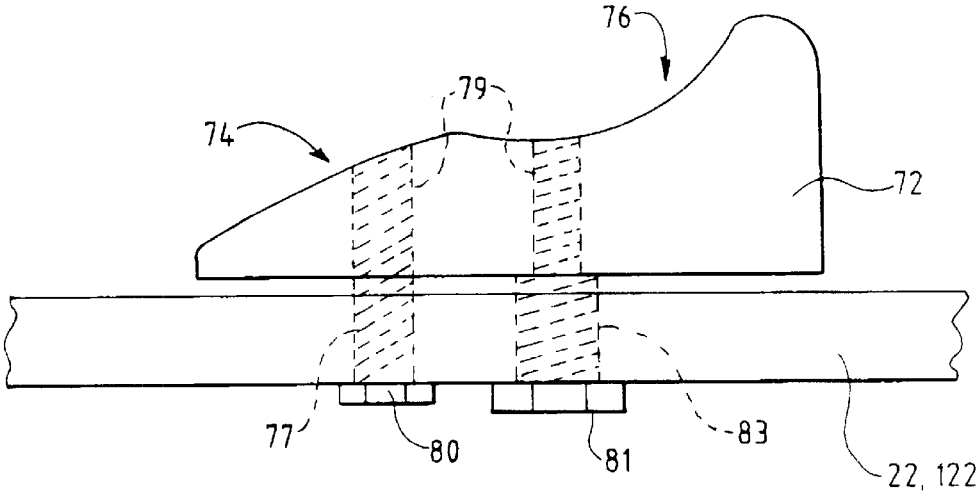
FIG. 5B is a side elevation view of a dogging wedge and jacking screw according to a preferred embodiment of the present invention.

Preferably, each contact location on door 22 comprises a dogging wedge 72, as illustrated in FIGS. 5A and 5B. That is, a dogging wedge 72 is attached to door 22 at each contact location on door 22 corresponding to a rotating dog 28. Therefore, door 22 as illustrated in the FIG. 1 embodiment includes eight dogging wedges 72. In alternate embodiments wherein the dogging mechanism is mounted on door 22, dogging wedges 72 are mounted on the door frame 24.

Each dogging wedge 72 has a contact surface including a crowned portion 74 and a detent 76. Dogging wedge 72 and crowned portion 74 thereof may be shaped as required to facilitate the motion of roller element 64 as rotating dog 28A, 28B rotates about axle 34, 35. Each dogging wedge 72 is situated on door 22 such that when the corresponding rotating dog 28A, 28B is rotated about axle 34, roller element 64 of rotating dog 28A, 28B makes contact with and rolls across crowned portion 74 of dogging wedge 72. As roller element 64 travels across crowned portion 74 of roller wedge 72, roller element 64 places an increasing force upon door 22, thus causing compression of the door seal (not shown) between door 22 and door frame 24.

At or near the limit of travel of rotating dog 28A, 28B toward the fully dogged position, wherein the desired compression of the door seal (not shown) has been substantially achieved, roller element 64 will have traveled to and come to rest in detent 76 of roller wedge 72. Once roller element 64 has come to rest within detent 76, rotating dog 28A, 28B will remain positively dogged until an operator takes affirmative action to undog rotating dog 28A, 28B from door 22 by, for example, applying an undogging force to handle 36.

Preferably, crowned portion 74 of dogging wedge 72 is contoured such that the rate of increase of compression of the door seal (not shown) decreases as roller element 64 travels over and across crowned portion 74 of dogging wedge 72 from the undogged position to the dogged position. Such a contour effectively increases the mechanical advantage of the operating mechanism as the dogging motion progresses. Further, crowned portion 74 preferably is contoured such that the surface of crowned portion 74 is substantially parallel to the plane of door 22 when the door seal (not shown) is nearly fully compressed. Such a contour helps to prevent spontaneous and undesired undogging when the dog roller is not yet seated in detent 76.

Preferably, dogging wedge 72 is attached to door 22 by inserting machine screw 80 through aperture 77 in door 22 and screwing machine screw 80 into corresponding threaded aperture 79 in dogging wedge 72, and by inserting machine screw 85 through aperture 83 in door 22 and screwing machine screw 85 into corresponding threaded aperture 79 in dogging wedge 72, as illustrated in FIG. 5A. Aperture 77 can be a through hole in door 22 and aperture 83 preferably is an oversized, threaded aperture, as will be discussed further below. In such embodiments, shims 82 can be installed between dogging wedge 72 and door 22, as required, to adjust the effective height of dogging wedge 72 relative to door 22 and, therefore, the compressive force placed on the door seal (not shown) by door 22 in response to the action of rotating dog 28A, 28B upon dogging wedge 72.

As illustrated in FIG. 5B, a temporary jacking bolt 81 can be used to help gauge the thickness of shim 82 which might be required to achieve the desired degree of compression of the door seal (not shown) with door 22 in the closed and dogged condition. In order to determine the required thickness of shim 82, door 22 is first closed and dogged, as described above. Then, machine screw 85 is removed from corresponding threaded aperture 79 and from door 22 and machine screw 80 is loosened, but preferably remains threaded into corresponding threaded aperture 79 in dogging wedge 72. Jacking screw 81 is then threaded into oversized, threaded aperture 83 in door 22 until contact is made with the surface of dogging wedge 72 adjacent to door 22. Jacking screw 81 is of larger diameter than machine screw 85 and corresponding threaded aperture 79 in dogging wedge 72. Therefore, jacking screw 81 will not engage with corresponding threaded aperture 79, but will instead impart a force on dogging wedge 72 so as to drive dogging wedge 72 away from door 22 and to drive door 22 into contact with the door seal (not shown).

Jacking screw 81 is turned into threaded aperture 83 until door 22 makes contact with the door seal (not shown) and then further until the desired compression of the door seal (not shown) has been achieved. At this point, the gap between door 22 and the surface of dogging wedge 72 adjacent door 22 can be measured and a shim 82 of appropriate thickness can be inserted therein. The gap can be measured using a feeler gauge or other measuring instrument. Alternatively, one can count the number of turns of jacking screw 81 required to move dogging wedge 72 from contact with door 22 to the point where desired compression of the door seal (not shown) has been achieved. Since the thread pitch of jacking screw 81 is known, the desired shim thickness can be calculated by multiplying the number of turns by the thread pitch of jacking screw 81. Jacking screw 81 then can be removed and replaced with machine screw 85 and machine screws 80 and 85 then can be torqued into corresponding threaded apertures 79 in dogging wedge 72.

In other embodiments, dogging wedge 72 can be attached to door 22 by any other suitable means, including, for example, welding.

Figure 6:
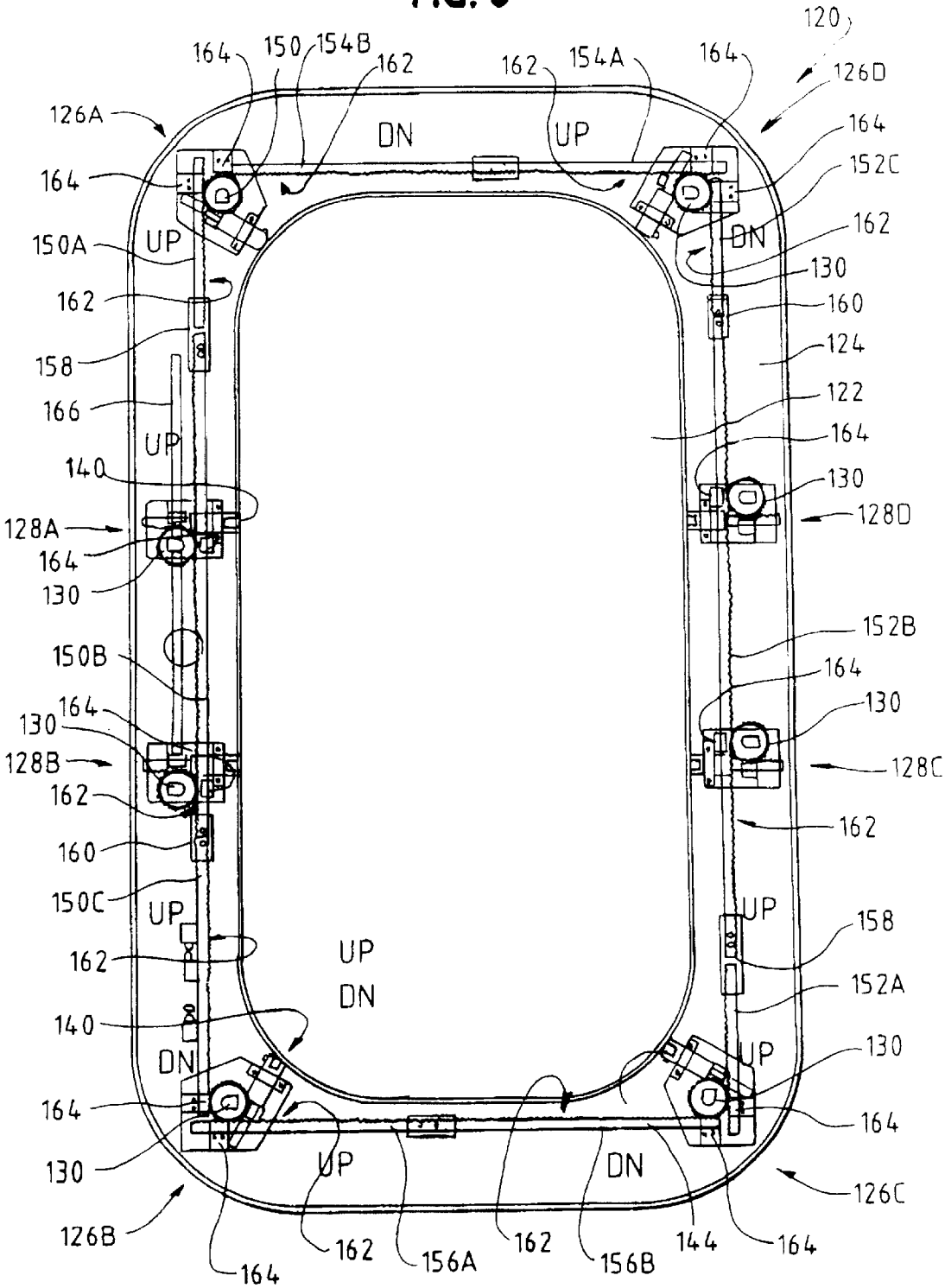
FIG. 6 is a front elevation view of a door closure mechanism in the dogged position according to a second preferred embodiment of the present invention.
Figure 7:
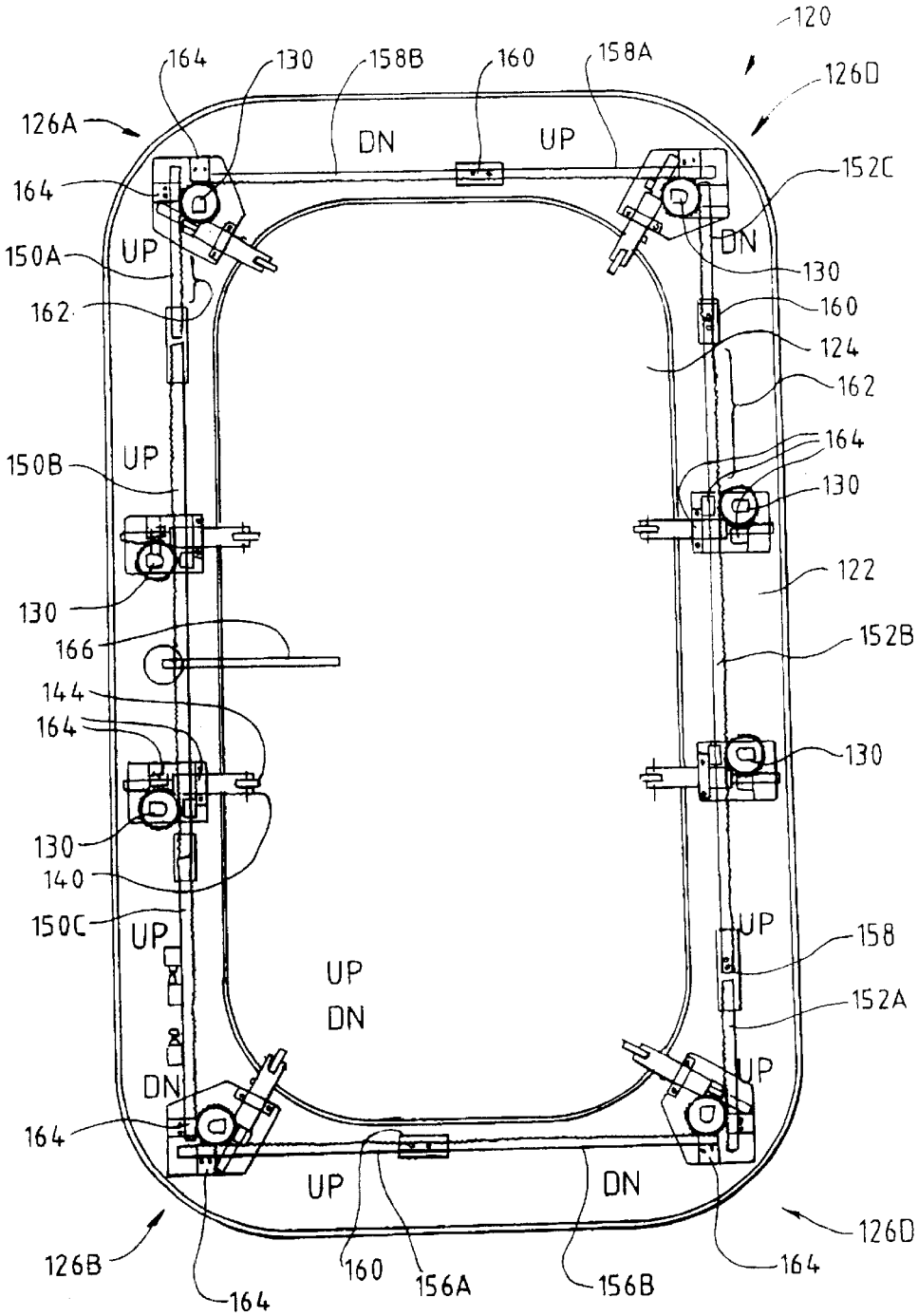
FIG. 7 is a front elevation view of a door closure apparatus in the undogged position according to a second preferred embodiment of the present invention.

FIGS. 6 and 7 illustrate a second preferred embodiment of a watertight door assembly 120 according to the present invention. Door assembly 120 includes a door 122, a door frame 124, a door seal (not shown), and a dogging mechanism for securing the door against the door frame in the closed position.

The dogging mechanism of this embodiment preferably includes four comer dog assemblies 126A–126D and four side dog assemblies 128A–128D. Each comer dog assembly 126A–126D and side dog assembly 128A–128D preferably includes a pinion gear set 130, a linear dog 140, and one or more guide sleeves 148, as will be discussed further below.

Figure 11:
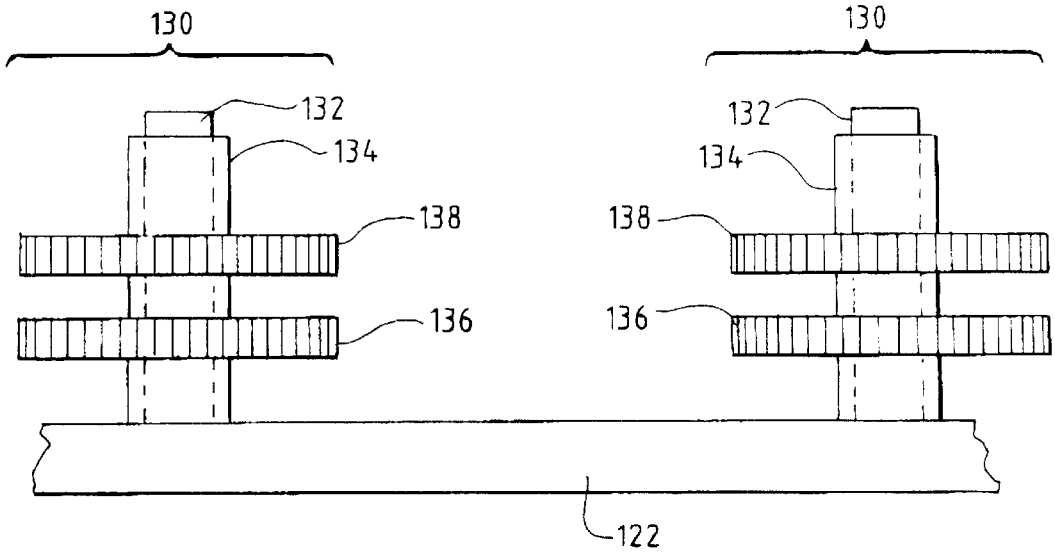
FIG. 11 is a detailed side elevation view of pinion gear sets mounted on a door according to a second preferred embodiment of the invention.

Referring also to FIG. 11, each pinion gear set 130 preferably includes a pinion shaft 132 which is attached to door frame 124; a bushing 134 which is mounted upon and can rotate about pinion shaft 132; a dog pinion gear 136; and an actuator pinion gear 138. Each of dog pinion gear 136 and actuator pinion gear 138 is mounted upon and keyed to bushing 134, as would be known to one skilled in the art. The eight actuator pinion gears 138 of this embodiment lie substantially in a first plane which is substantially parallel to the plane of door frame 124. The eight dog pinion gears 134 of this embodiment lie substantially in a second plane which also is substantially parallel to the plane of door frame 124 and which lies between the first plane and door frame 124. In an alternate embodiment, each dog pinion gear 136 and actuator pinion gear 138 can be replaced with a single, wide pinion gear.

Figure 12:
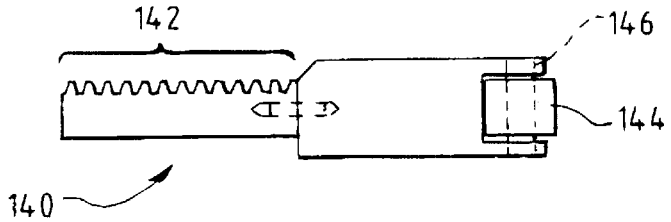
FIG. 12 is a detailed plan view of a linear dog according to a second preferred embodiment of the invention.

Referring also to FIG. 12, each linear dog 140 includes a portion 142 having gear teeth formed therein, a roller element 144, and an roller axle 146. Each linear dog 140 is positioned so that toothed portion 142 of linear dog 140 meshes with the teeth of dog pinion gear 136. Each linear dog 140 is supported by a dog guide channel 176 and a dog guide sleeve 178.

The dogging mechanism of this second preferred embodiment also includes a left side jamb rack 150, a right side jamb rack 152, a header rack 154, and a sill rack 156. Preferably, each rack 150, 152, 154, 156 is fabricated from bar stock having rectangular cross section, although racks 150, 152, 154, 156 can be fabricated from stock having other shapes, as well.

Referring to FIGS. 6 and 7, left side jamb rack 150 preferably is fabricated in three sections 150A, 150B, 150C wherein section 150A is connected to section 150B using an inline splice 158, and section 150B is connected to section 150C using lap splice 160.

Similarly, right side jamb rack 152 is fabricated in three sections 152A, 152B, 152C, wherein section 152A is connected to section 152B using an in-line splice 158 and section 150B is connected to section 150C using a lap splice 160. Header rack 154 preferably is fabricated in two sections 154A, 154B, wherein section 154A is connected to section 154B using a lap splice 160. Sill rack 156 preferably is fabricated in two sections 156A, 156B, wherein section 156A is connected to section 156B using a lap splice 160.

Figure 8A:
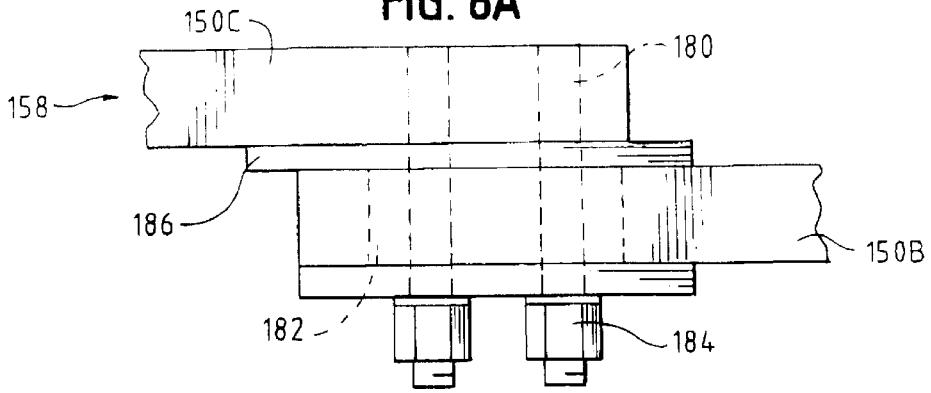
FIG. 8A is a detailed side elevation view of an actuator rack lap splice according to a second preferred embodiment of the present invention.
Figure 8B:
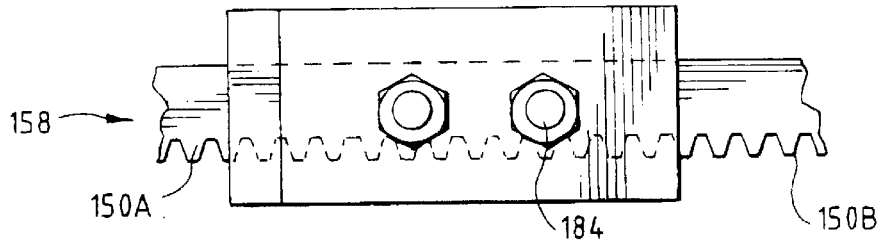
FIG. 8B is a detailed plan view of a portion of an actuator rack lap splice according to a second preferred embodiment of the present invention.

Referring to FIGS. 8A and 8B, lap splice 160 can be made by forming round apertures 180 into the end of rack section 150C to be joined to rack section 150B; forming slotted apertures 182 into the end of rack section 150B to be joined to rack section 150C; overlapping apertures 180 and 182; and connecting rack section 150B to rack section 150C using threaded fasteners 184 through apertures 180 and 182. Slotted apertures 182 permit adjustment of the overall length of the corresponding rack to adjust the timing of the dogging mechanism so that all eight linear dogs extend and retract in unison upon actuation of the dogging mechanism, as will be discussed further below. As is apparent from this description and from inspection of FIGS. 9A and 9B, the two rack sections, for example rack sections 150B and 150C, joined using such a lap splice lie in two different planes. Shim 186 can be used to increase the separation of the planes in which these two rack sections lie in order to obtain proper alignment of the rack sections with corresponding pinion gears 136, 138. A lap splice 160 can be used in a similar manner to join rack section 152B to rack section 152C, to join rack section 154A to rack section 154B, and to join rack section 156A to rack section 156B.

Figure 9A:
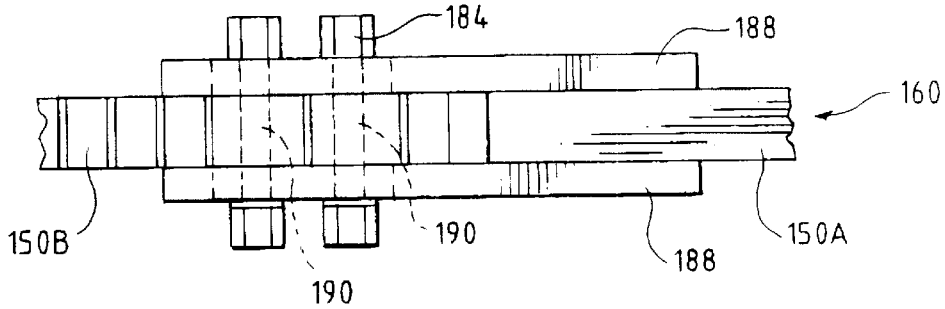
FIG. 9A is a detailed side elevation view of an actuator rack in-line splice according to a second preferred embodiment of the present invention.
Figure 9B:
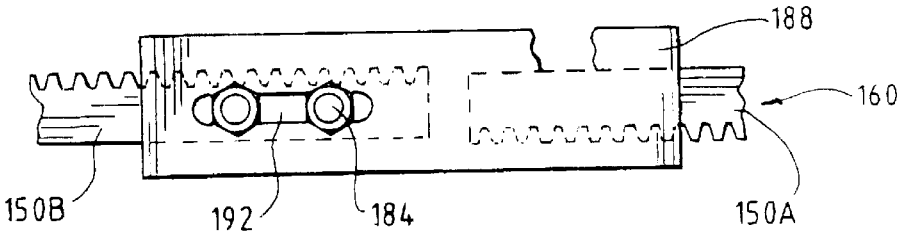
FIG. 9B is a detailed plan view of a portion of an actuator rack in-line splice according to a second preferred embodiment of the present invention.

Referring to FIGS. 9A and 9B, in-line splice 158 includes, for example, splice plates 188 and threaded fasteners 184. A first end of each splice plate 188 is welded or otherwise attached to the end of rack section 150A to be joined to rack section 150B. A slotted aperture 192 preferably is formed into the second end of each splice plate 188. Round apertures 190 preferably are formed into the end of rack section 150B to be joined to the end of rack section 150A. Alternatively, slotted aperture 192 can be formed into rack 150B and round apertures 190 can be formed into each splice plate 188. Threaded fasteners 184 are inserted through slotted hole 192 in each splice plate 188 and round holes 190 in the end of rack section 150B to secure an end an end of rack section 150B to splice plates 188 and therefore to rack section 150A. Slotted holes 192 permit adjustment of the overall length of the corresponding rack to adjust the timing of the dogging mechanism so that all eight linear dogs extend and retract in unison upon actuation of the dogging mechanism, as will be discussed further below. An inline splice 158 can be used in a similar manner to join rack section 152A to rack section 152B.

Each of rack sections 150A, 150B, 150C, 152A, 152B, 152C, 154A, 154B, 156A, 156B includes a portion into which gear teeth 162 have been formed. Rack section 150A is oriented so that toothed portion 162 thereof meshes with the teeth of actuator pinion gear 138 of corner dog assembly 126A. Rack section 150B is oriented so that toothed portion 162 thereof meshes with the teeth of actuator pinion gears 138 of side dog assemblies 128A and 128B. Rack section 150C is oriented so that toothed portion 162 thereof meshes with the teeth of dog pinion gear 136 of corner dog assembly 126B.

Similarly, rack section 152A is oriented so that toothed portion 162 thereof meshes with the teeth of actuator pinion gear 138 of corner dog assembly 126C. Rack section 152B is oriented so that toothed portion 162 thereof meshes with the teeth of actuator pinion gears 138 of side dog assemblies 128C and 128D. Rack section 152C is oriented so that toothed portion 162 thereof meshes with the teeth of dog pinion gear 136 of comer dog assembly 126D.

Header rack section 154A is oriented so that toothed portion 162 thereof meshes with the teeth of actuator pinion gear 138 of comer dog assembly 126D. Header rack section 154B is oriented so that toothed portion 162 thereof meshes with the teeth of dog pinion gear 136 of comer dog assembly 126A. Sill rack section 156A is oriented so that toothed portion 162 thereof meshes with the teeth of actuator pinion gear 138 of comer dog assembly 126B. Sill rack section 156B is oriented so that toothed portion 162 thereof meshes with the teeth of dog pinion gear 136 of comer dog assembly 126C.

Each of rack sections 150A, 150B, 150C, 152A, 152B, 152C, 154A, 154B, 156A, 156B is supported by a corresponding rack support 164 which preferably is located at each of comer dog assemblies 126A–126D and side dog assemblies 128A–128D. Alternatively, rack supports 164 can be provided at other or additional locations about door frame 124.

The dogging mechanism also includes an operating handle 166. Operating handle 166 according to this embodiment preferably is mounted upon and keyed to a shaft 168 which, in tum, is attached to door frame 124. A handle pinion gear 170 also is mounted upon and keyed to shaft 168 so that handle pinion gear 170 rotates in response to an appropriate force applied to handle 166. Handle pinion gear is 170 oriented so that the teeth of handle pinion gear 170 mesh with the gear teeth 162 formed into, for example, rack section 150B. In alternate embodiments, operating handle 166 can be mounted upon and keyed to the bushing 134 corresponding to any of pinion gear sets 126A–126D or 128A–128D.

Based on the foregoing description and the accompanying drawings, it should be apparent to one skilled in the art that manipulation of operating handle 166 from the dogged position illustrated in FIG. 6 to the undogged position illustrated in FIG. 7 will impart rotation to handle pinion gear 170. Rotation of handle pinion gear 170 will impart upwardly linear motion to left side jamb rack 150. This upwardly linear motion of left side jamb rack 150 will impart clockwise rotation to the pinion gear sets 130 located at each of comer dog assemblies 126A, 126B and counterclockwise rotation to the pinion gear sets 130 located at each of side dog assemblies 128A, 128B, in turn imparting leftward linear motion to linear dogs 140 so that these linear dogs 140 retract from door 122.

The clockwise rotation of the pinion gear set 130 located at comer dog assembly 126A further imparts rightward linear motion of header rack 156, in turn causing clockwise rotation of pinion gear set 130 at corner dog assembly 126D. The clockwise rotation of the pinion gear set 130 located at comer dog assembly 126B further imparts leftward linear motion of sill rack 158, in turn causing clockwise rotation of pinion gear set 130 at comer dog assembly 126C. This clockwise rotation of pinion gear sets 130 at comer dog assemblies 126C, 126D imparts rightward linear motion to linear dogs 140 at comer dog assemblies 126C, 126D so that these linear dogs 140 retract from door 122. The clockwise rotation of pinion gear sets 130 at corner dog assemblies 126C, 126D further imparts downward linear motion to right side jamb rack 154 which, in turn, imparts counterclockwise rotation to pinion gear sets 130 at each of side dog assemblies 128C, 128D. The counterclockwise rotation of pinion gear sets 130 at each of side dog assemblies 128C, 128D imparts rightward linear motion to the corresponding linear dogs 140, so that these linear dogs 140 retract from door 122.

Similarly, it should be apparent that the opposite chain of events takes place when operating handle 166 is manipulated from the undogged position illustrated in FIG. 7 to the dogged position illustrated in FIG. 6. That is, such manipulation of handle 166 causes handle pinion gear 170 to rotate in a clockwise direction, imparting downwardly linear motion to left side jamb rack 150. This downwardly linear motion of left side jamb rack 150 will impart counterclockwise rotation to the pinion gear sets 130 located at each of comer dog assemblies 126A, 126B and clockwise rotation to the pinion gear sets 130 located at each of side dog assemblies 128A, 128B, in turn imparting rightward linear motion to linear dogs 140 so that these linear dogs 140 extend towards and across corresponding contact locations on door 122.

The counterclockwise rotation of the pinion gear set 130 located at comer dog assembly 126A further imparts leftward linear motion of header rack 156, in turn causing counterclockwise rotation of pinion gear set 130 at comer dog assembly 126D. The counterclockwise rotation of the pinion gear set 130 located at comer dog assembly 126B further imparts rightward linear motion of sill rack 158, in turn causing counterclockwise rotation of pinion gear set 130 at comer dog assembly 126C. This counterclockwise rotation of pinion gear sets 130 at comer dog assemblies 126C, 126D imparts leftward linear motion to linear dogs 140 at comer dog assemblies 126C, 126D so that these linear dogs 140 extend towards and across corresponding contact locations on door 122. The counterclockwise rotation of pinion gear sets 130 at comer dog assemblies 126C, 126D further imparts upward linear motion to right side jamb rack 154 which, in turn, imparts clockwise rotation to pinion gear sets 130 at each of side dog assemblies 128C, 128D. The clockwise rotation of pinion gear sets 130 at each of side dog assemblies 128C, 128D imparts leftward linear motion to the corresponding linear dogs 140, so that these linear dogs 140 extend towards and across corresponding contact locations on door 122.

Preferably, each contact location on door 122 includes a dogging wedge 72 as illustrated in FIG. 5 and as described above. In operation, as roller element 144 of linear dog 140 travels across dogging wedge 72, roller element 144 places an increasing force upon door 122, thus causing compression of the door seal (not shown) between door 122 and door frame 124.

At or near the limit of travel of linear dog 140 toward the fully dogged position, wherein the desired compression of the door seal (not shown) has been substantially achieved, roller element 144 will have traveled to and come to rest in detent 76 of roller wedge 72. Once roller element 144 has come to rest within detent 76, linear dog 140 will remain positively dogged until an operator takes affirmative action to undog linear dog 140 from door 122 by, for example, applying an undogging force to handle 166.

Preferably, crowned portion 74 of dogging wedge 72 is contoured such that the rate of increase of compression of the door seal (not shown) decreases as roller element 144 travels over and across crowned portion 74 of dogging wedge 72 from the undogged position to the dogged position. Such a contour effectively increases the mechanical advantage of the operating mechanism as the dogging motion progresses. Further, crowned portion 74 preferably is contoured such that the surface of crowned portion 74 is substantially parallel to the plane of door 122 when the door seal (not shown) is nearly fully compressed. Such a contour helps to prevent spontaneous and undesired undogging when the dog roller is not yet seated in detent 76.

Preferably, dogging wedge 72 is attached to door 122 in a manner similar to that discussed above for the first preferred embodiment, as illustrated in FIGS. 5A and 5B. In such embodiments, shims 82 can be installed between dogging wedge 72 and door 122, as required, to adjust the effective height of dogging wedge 72 relative to door panel 122 and, therefore, the compressive force placed on the door seal (not shown) by door 122 in response to the action of rotating dog 28A, 28B upon dogging wedge 72. The desired thickness of shim 82 can be determined in a manner similar to that described above for the first preferred embodiment and as illustrated in FIGS. 5A and 5B.

In other embodiments, dogging wedge 72 can be attached to door 122 by any other suitable means, including, for example, welding.

In both of the embodiments described herein, the dogging mechanism is illustrated as being attached to the door frame such that the dogs act upon the door. In alternate embodiments, the dogging mechanism can be attached to the door itself such that the dogs act upon the door frame.

The foregoing embodiments are intended to demonstrate the principles of the invention, but they are not intended to limit the invention's scope. Many additional embodiments are possible without deviating from the spirit of the invention, whose scope is defined solely by the appended claims.

We claim:

1. A fluid-tight door apparatus comprising:

a door;

a door frame;

a plurality of dogs rotatably connected to one of said door and said door frame and configured for selective engagement with the other of said door and said door frame;

each of said plurality of dogs including a rolling element, at least a portion of said rolling element being substantially frusto-conical; and a mechanism for selectively rotating each of said dogs into engagement with the other of said door and said door frame;

wherein said rolling element rolls across a portion of the other of said door and said door frame when said mechanism selectively rotates each of said dogs into engagement with the other of said door and said door frame.

2. The apparatus of claim 1 wherein said mechanism comprises a first plurality of rotating dog actuators, a second plurality of rotating dog actuators, and a linkage for interconnecting said first plurality of rotating dog actuators and said second plurality of rotating dog actuators, wherein each of said first plurality of rotating dog actuators is attached to one of said plurality of dogs, wherein each of said second plurality of rotating dog actuators is attached to one of said plurality of dogs.

3. The apparatus of claim 2 wherein each of said first plurality of rotating dog actuators comprises a sprocket, an axle, and a chain, said chain being connected to said linkage, said chain being engaged with said sprocket, said sprocket being selectively rotatable about said axle in response to a force applied to said sprocket by said chain.

4. The apparatus of claim 1 further comprising a dogging wedge attached to the other of said door and door frame.

5. The apparatus of claim 4 wherein said dogging wedge comprises a crowned portion and a detent.

6. The apparatus of claim 5 wherein said crowned portion has a variable slope.

7. The apparatus of claim 6 wherein a portion of said crowned portion adjacent said detent is substantially parallel to a plane of said door and door frame.

8. A fluid-tight door apparatus comprising:

a door;

a door frame;

a plurality of dogs rotatably connected to one of said door and said door frame and configured for selective engagement with the other of said door and said door frame; and a mechanism for selectively rotating each of said dogs into engagement with the other of said door and said door frame, wherein said mechanism comprises a plurality of rotating dog actuators and a linkage for interconnecting said plurality of rotating dog actuators, wherein each of said plurality of rotating dog actuators is attached to one of said plurality of dogs, and wherein each of said plurality of rotating dog actuators comprises a bellcrank and an axle, said bellcrank being connected to said linkage, and said bellcrank being selectively rotatable about said axle in response to a force applied to said bellcrank by said linkage.

9. The apparatus of claim 8 wherein said linkage passes through a channel in said bellcrank.

10. A fluid-tight door apparatus comprising:

a door;

a door frame;

a plurality of dogs movably connected to one of said door and said door frame, each of said dogs configured for selective engagement with a corresponding portion of the other of said door and said door frame;

each of said dogs including a rolling element having a first axis, said rolling element being mounted in a cradle such that said rolling element has at least two degrees of freedom with respect to said dog;

a mechanism for selectively moving each of said dogs into engagement with said corresponding portion of the other of said door and said door frame;

wherein said rolling element rolls across said corresponding portion of the other of said door and said door frame when said mechanism selectively moves each of said dogs into engagement with said corresponding portion of the other of said door and said door frame.

11. The apparatus of claim 10 further comprising a dogging wedge attached to the other of said door and said door frame.

12. The apparatus of claim 11 wherein said dogging wedge comprises a crowned portion and a detent.

13. The apparatus of claim 12 wherein said crowned portion has a variable slope.

14. The apparatus of claim 13 wherein a portion of said crowned portion adjacent said detent is substantially parallel to a plane of said door and door frame.

15. The apparatus of claim 10 wherein a first of said at least two degrees of freedom comprises rotation of said rolling element about said first axis.

16. The apparatus of claim 10 wherein a second of said at least two degrees of freedom comprises rotation about an axis substantially perpendicular to said first axis.

17. The apparatus of claim 10 wherein at least a portion of said rolling element is substantially frusto-conical.

18. The apparatus of claim 10 wherein said corresponding portion of the other of said door and said door frame comprises an element connected thereto.

19. A fluid-tight door apparatus comprising:

a door;

a door frame;

a resilient, compressible seal between said door and said door frame;

a dogging wedge adjustably connected to one of said door and said door frame;

a dog movably connected to the other of said door and said door frame, said dog configured for selective engagement with said dogging wedge;

a jack screw operably associated with said dogging wedge, said jack screw configured to adjustably displace said dogging wedge away from the corresponding one of said door and said door frame to effect adjustable compression of said dogging wedge against said dog when said dogging wedge is engaged with said dog, thereby enabling adjustable compression of said resilient, compressible seal.

20. A fluid-tight door apparatus comprising:

a door;

a door frame;

a plurality of dogs rotatably connected to one of said door and said door frame, each of said plurality of dogs configured for selective engagement with a corresponding portion of the other of said door and said door frame;

each of said dogs including a rolling element, at least a portion of said rolling element being substantially frusto-conical; and a mechanism for selectively rotating each of said dogs into engagement with said corresponding portion of the other of said door and said door frame;

wherein said rolling element rolls across said corresponding portion of the other of said door and said door frame when said mechanism selectively rotates each of said dogs into engagement with said corresponding portion of the other of said door and said door frame.

21. The apparatus of claim 20 wherein said corresponding portion of the other of said door and said door frame comprises an element connected thereto.

* * * * *